US011795517B2

(12) United States Patent
Luo et al.

(10) Patent No.: US 11,795,517 B2
(45) Date of Patent: Oct. 24, 2023

(54) DEVICE AND METHOD FOR PERFORMING CONTINUOUS CARBONATION AND IMPURITY REMOVAL FOR XYLOSE MOTHER LIQUOR

(71) Applicants: Zhejiang Huakang Pharmaceutical Co., Ltd., Zhejiang (CN); Zhejiang University of Technology, Zhejiang (CN)

(72) Inventors: Jiaxing Luo, Zhejiang (CN); Guowei Luo, Zhejiang (CN); Chengjun Liao, Zhejiang (CN); Songtao Jiang, Zhejiang (CN); Yuan Zhou, Zhejiang (CN); Deshui Chen, Zhejiang (CN); Zhiqiang Liu, Zhejiang (CN); Xiaojian Zhang, Zhejiang (CN); Yuguo Zheng, Zhejiang (CN); Mian Li, Zhejiang (CN)

(73) Assignees: Zhejiang Huakang Pharmaceutical Co., Ltd., Zhejiang (CN); Zhejiang University of Technology, Zhejiang (CN)

( * ) Notice: Subject to any disclaimer, the term of this patent is extended or adjusted under 35 U.S.C. 154(b) by 351 days.

(21) Appl. No.: 17/288,068

(22) PCT Filed: Dec. 6, 2019

(86) PCT No.: PCT/CN2019/123825

§ 371 (c)(1),
(2) Date: Apr. 23, 2021

(87) PCT Pub. No.: WO2020/125459

PCT Pub. Date: Jun. 25, 2020

(65) Prior Publication Data

US 2021/0381069 A1 Dec. 9, 2021

(30) Foreign Application Priority Data

Dec. 18, 2018 (CN) ..... 201811550349.7

(51) Int. Cl.
*C13K 13/00* (2006.01)

(52) U.S. Cl.
CPC ..... *C13K 13/002* (2013.01)

(58) Field of Classification Search
None
See application file for complete search history.

(56) References Cited

U.S. PATENT DOCUMENTS

| | | | | |
|---|---|---|---|---|
| 1,941,461 A * | 1/1934 | Bull | C13B 20/06 | 127/50 |
| 2,164,186 A * | 6/1939 | Brown | C13B 20/06 | 127/50 |
| 2010/0184151 A1* | 7/2010 | Tolan | C12P 19/14 | 435/157 |

FOREIGN PATENT DOCUMENTS

| | | |
|---|---|---|
| CN | 101457261 | 6/2009 |
| CN | 104437060 | 3/2015 |

(Continued)

OTHER PUBLICATIONS

PCT International Search Report in International Appln. No. PCT/CN2019/123825, dated Mar. 12. 2020, 6 pages (with English translation).

*Primary Examiner* — Stefanie J Cohen
(74) *Attorney, Agent, or Firm* — Fish & Richardson P.C.

(57) ABSTRACT

Related to are a device and a method for performing continuous carbonation and impurity removal for xylose mother liquor. The device includes an alkali addition unit, a continuous carbonating unit, a discharge controlling unit, a $CO_2$ supply station, a vapor station and an after-carbonation tank, wherein the alkali addition unit is configured to add $Ca(OH)_2$ alkaline liquid into xylose mother liquor, the continuous carbonating unit is configured to introduce $CO_2$ supplied from the $CO_2$ supply station into the alkali-added xylose mother liquor to perform carbonation and mixing so (Continued)

as to remove impurities such as colloid and pigment in xylose mother liquor, the discharge controlling unit is configured to introduce $CO_2$ supplied from the $CO_2$ supply station and vapor transported from the vapor station into the carbonated xylose mother liquor so as to control and stabilize a pH value of the carbonated xylose mother liquor, and the after-carbonation tank is configured to collect and temporarily store the carbonated and impurity-removed xylose mother liquor so as to prepare for a next procedure. Further, a method using the device is disclosed. According to the device and the method, the pH of xylose mother liquor is continuously regulated and stabilized and continuous feeding and discharge are performed with highly automated device so as to achieve continuous and uninterrupted production, and thus facilitate improving the production efficiency.

10 Claims, 1 Drawing Sheet

(56) References Cited

FOREIGN PATENT DOCUMENTS

| | | |
|---|---|---|
| CN | 104805222 | 7/2015 |
| CN | 109402.300 | 3/2019 |

* cited by examiner

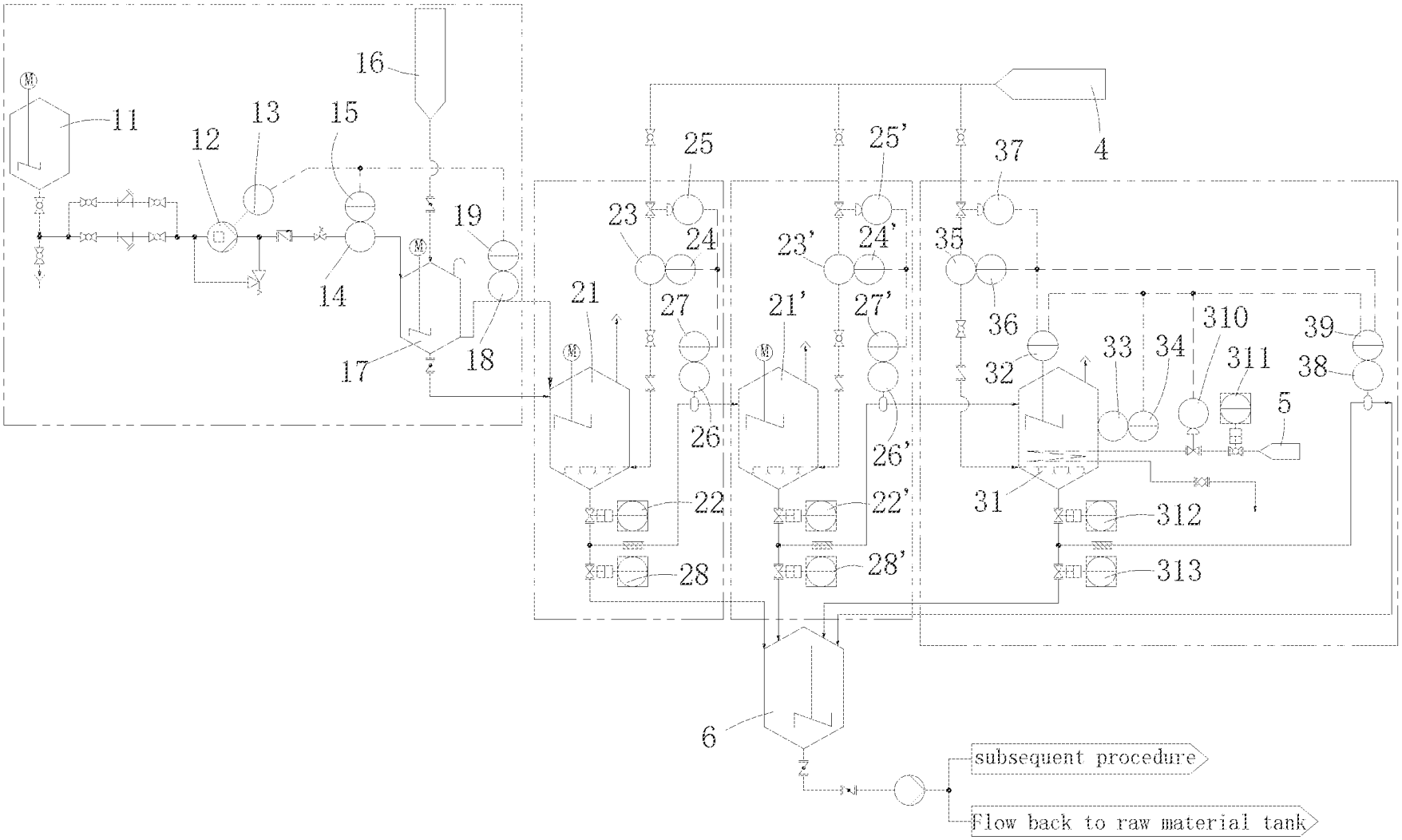
subsequent procedure
flow back to raw material tank
4
5
6
11
12
13
14
15
16
17
18
19
21
21'
22
22'
23
23'
24
24'
25
25'
26
26'
27
27'
28
28'
31
32
33
34
35
36
37
38
39
310
311
312
313

DEVICE AND METHOD FOR PERFORMING CONTINUOUS CARBONATION AND IMPURITY REMOVAL FOR XYLOSE MOTHER LIQUOR

CROSS REFERENCE TO RELATED APPLICATIONS

This application is a national phase filing under 35 U.S.C. § 371 of International Application No. PCT/CN2019/123825, filed Dec. 6, 2019, which claims priority from Chinese Application No. 201811550349.7, filed Dec. 18, 2018. The entire contents of the prior applications are incorporated herein by reference in their entirety.

FIELD OF THE INVENTION

The present disclosure belongs to the technical field of xylose mother liquor recycling, and relates to a device and a method for performing continuous carbonation and impurity removal for xylose mother liquor.

BACKGROUND OF THE INVENTION

Xylose is a pentose produced by acid hydrolysis, crystallization and refining of corn cobs. Xylose mother liquor left after crystallization of xylose contains about 50% of xylose. At present, there are many domestic xylose manufacturers. A large quantity of by-product, i.e., xylose mother liquor, increases along with the increase of xylose output. Nearly one ton of xylose mother liquor may be obtained from the production of each ton of crystal xylose. The composition of xylose mother liquor is determined, mainly containing sugar ingredients such as xylose, arabinose, glucose and galactose as well as some impurities such as colloids and pigments. Currently, most of xylose mother liquor is sold at a low price for the production of caramel pigments, feed yeasts and so on. How to effectively separate the ingredients such as xylose, arabinose, glucose and galactose and remove the impurities such as colloids and pigments from xylose mother liquor have become a challenge and an opportunity for the development of the xylose industry. If the valuable ingredients in xylose mother liquor can be extracted with impurities removed, the utilization value of xylose mother liquor will be greatly improved. Thus, wastes can be recycled to bring benefits.

The carbonating apparatuses currently used in sugar factories have disadvantages of long carbonation time, low $CO_2$ utilization rate, uneven reaction, discontinuous feeding and discharge, unstable pH control of sugar liquid, and low automation degree. Therefore, there is no satisfied continuous carbonating and impurity-removing device at present.

SUMMARY OF THE INVENTION

The present disclosure provides a device and a method for performing continuous carbonation and impurity removal for xylose mother liquor. An automatic control system is adopted to continuously regulate and stabilize the pH of sugar liquid and perform continuous feeding and discharge with high automation degree of equipment, thereby realizing continuous production, and helping to improve the productivity. Therefore, the present disclosure is suitable for the industrial production of xylose mother liquor recycling.

The present disclosure is achieved by providing a device for performing continuous carbonation and impurity removal for xylose mother liquor, including an alkali addition unit, a continuous carbonating unit, a discharge controlling unit, a $CO_2$ supply station, a vapor station and an after-carbonation tank. The alkali addition unit is configured to add $Ca(OH)_2$ liquid into xylose mother liquor. The continuous carbonating unit is configured to introduce $CO_2$ supplied from the $CO_2$ supply station into the alkali-added xylose mother liquor to perform carbonation and mixing so as to remove colloids and pigments in xylose mother liquor. The discharge controlling unit is configured to introduce the $CO_2$ supplied from the $CO_2$ supply station and vapor transported from the vapor station into the carbonated xylose mother liquor so as to control and stabilize a pH value of the carbonated xylose mother liquor. The after-carbonation tank is configured to collect and temporarily store the carbonated and impurity-removed xylose mother liquor until the subsequent procedure.

The discharge controlling unit includes a discharge carbonation tank, a variable-frequency mixer, a tank temperature sensor, a tank temperature controller, a $CO_2$ inlet flow controller, a $CO_2$ inlet regulating valve, a discharge pH sensor, a discharge pH controller, a vapor regulating valve and a discharge switching valve. The discharge carbonation tank collects the carbonated xylose mother liquor transported from the continuous carbonating unit. $CO_2$ in the $CO_2$ supply station flows through the $CO_2$ inlet flow controller and then enters the discharge carbonation tank. The vapor station introduces vapor into the discharge carbonation tank through the vapor regulating valve. The after-carbonation tank stores the processed xylose mother liquor flowing through the discharge switching valve. The variable-frequency mixer mixes xylose mother liquor in the discharge carbonation tank. The tank temperature sensor monitors the temperature of the discharge carbonation tank. The discharge pH sensor monitors the pH value of the discharged xylose mother liquor. The variable-frequency mixer, the tank temperature controller, the discharge pH controller and the vapor regulating valve are interlocked with each other. The tank temperature controller regulates an opening degree of the vapor regulating valve according to the discharge pH value and controls the variable-frequency mixer at the same time. The variable-frequency mixer, the $CO_2$ inlet flow controller, the $CO_2$ inlet regulating valve and the discharge pH controller are interlocked with each other. The discharge pH controller controls a flow of $CO_2$ output by the $CO_2$ supply station to the discharge carbonation tank according to the discharge pH value and controls the variable-frequency mixer at the same time.

Further, the alkali addition unit includes an alkaline liquid tank, an alkaline liquid pump, a xylose mother liquor tank, a before-carbonation tank and a first pH sensor. The alkaline liquid is transported from the alkaline liquid tank to the before-carbonation tank through the alkaline liquid pump and mixed with xylose mother liquor from xylose mother liquor tank in the before-carbonation tank, the mixed xylose mother liquor then flows into the continuous carbonating unit, and the first pH sensor monitors the pH value of the alkali-added xylose mother liquor transported to the continuous carbonating unit.

Further, the continuous carbonating unit includes a first continuous carbonation tank, a first switching valve, a first $CO_2$ inlet regulating valve and a second pH sensor. The first continuous carbonation tank collects xylose mother liquor added with the alkaline liquid, the $CO_2$ in the $CO_2$ supply station enters the first continuous carbonation tank to perform carbonation and impurity removal with xylose mother liquor therein, the carbonated xylose mother liquor flows through the first switching valve and then enters the discharge controlling unit, and the second pH sensor monitors the pH change of the carbonated xylose mother liquor transported to the discharge controlling unit.

Further, the described device for performing continuous carbonation and impurity removal for xylose mother liquor is provided with two levels of continuous carbonating units. The second-level continuous carbonating unit includes a second continuous carbonation tank, a second switching valve, a second $CO_2$ inlet regulating valve and a third pH sensor. The carbonated xylose mother liquor of the first-level continuous carbonating unit enters the second continuous carbonation tank of the second-level continuous carbonating unit under the control of the second pH controller to perform second carbonation and impurity removal, and the secondly-carbonated xylose mother liquor flows through the second switching valve and then enters the discharge controlling unit; the $CO_2$ in the $CO_2$ supply station enters the second continuous carbonation tank to perform second carbonation and mixing with xylose mother liquor therein, and the third pH sensor monitors a change of the pH value of the secondly-carbonated xylose mother liquor transported to the discharge controlling unit.

Further, the first-level continuous carbonating unit includes a first discharge straight-through valve. When the first switching valve is open, the carbonated xylose mother liquor in the first continuous carbonation tank directly flows into the after-carbonation tank rather than passes through a pipeline where the second pH sensor is located. The second-level continuous carbonating unit further includes a second discharge straight-through valve. When the second switching valve is open, the carbonated xylose mother liquor in the second continuous carbonation tank directly flows into the after-carbonation tank rather than passes through a pipeline where the third pH sensor is located.

Further, the discharge controlling unit includes a discharge straight-through valve. When the discharge switching valve is open, the processed xylose mother liquor in the discharge carbonation tank directly flows into the after-carbonation tank rather than passes through a pipeline where the discharge pH sensor is located.

The present disclosure is achieved by providing a method of performing continuous carbonation and impurity removal for xylose mother liquor by using the device as described above. The method includes the following steps: xylose mother liquor is mixed with the added alkaline liquid in the alkali addition unit, and then enters the continuous carbonating unit to perform carbonation and mixing with $CO_2$ supplied from the $CO_2$ supply station to remove colloids and pigments, and xylose mother liquor then enters the discharge controlling unit to perform carbonation and mixing again with $CO_2$ supplied from the $CO_2$ supply station and vapor transported from the vapor station to control and stabilize the pH value of the carbonated xylose mother liquor, and then, the impurity-removed xylose mother liquor is discharged to the after-carbonation tank for temporary storage so as to prepare for the next procedure.

Further, the method of performing continuous carbonation and impurity removal for xylose mother liquor includes the following steps.

At step 1, the pH of xylose mother liquor is increased by adding alkaline liquid. Xylose mother liquor with a refraction index being 50%-65% is added into the before-carbonation tank at a flow rate of 8 $m^3$/h to 12 $m^3$/h. The alkaline liquid pump is switched on to add $Ca(OH)_2$ alkaline liquid into the before-carbonation tank when a liquid level reaches 30%-35% of the capacity of the before-carbonation tank, and the flow rate of the $Ca(OH)_2$ alkaline liquid is between 40 L/h and 55 L/h at this time. The pH value of the first pH sensor is set between 9.5 and 10.5 for real time monitoring. Xylose mother liquor discharges to the continuous carbonating unit is started when the liquid level of xylose mother liquor in the before-carbonation tank exceeds 70%.

At step 2, the pH value of xylose mother liquor is stepwise decreased continuously.

When the liquid level of the alkali-added xylose mother liquor reaches 30%-35% of the first continuous carbonation tank of the first-level continuous carbonating unit, an opening degree of the first $CO_2$ inlet regulating valve is controlled to 50%-65%, and the $CO_2$ flow rate is between 20 L/h and 25 L/h at this time; the second pH sensor is set to the value of 8.0-8.5, the first switching valve is open, and discharge to the second-level continuous carbonating unit when the liquid level of xylose mother liquor in the first continuous carbonation tank exceeds 70%.

When the liquid level reaches 30%-35% of the capacity of the second continuous carbonation tank in the second-level continuous carbonating unit, an opening degree of the second $CO_2$ inlet regulating valve is controlled to 25%-40%, and the $CO_2$ flow rate is 2 L/h to 2.5 L/h at this time; the third pH sensor is set to the value of 6.5-7.0, the second switching valve is open, and discharge to the discharge controlling unit when the liquid level of the second continuous carbonation tank exceeds 70%.

At step 3, the pH value of carbonated xylose mother liquor during discharge is stabilized. When xylose mother liquor in the second continuous carbonation tank discharges to the discharge carbonation tank, the discharge switching valve and the vapor switching valve are open; the discharge pH sensor is set to 6.5-7.0, and the discharge pH sensor continuously monitors the pH. When the pH value of the discharged xylose mother liquor is less than 6.5, the variable-frequency mixer is started for mixing interlockedly, the vapor regulating valve is regulated for its opening degree, and the liquid temperature of xylose mother liquor is controlled between 50° C. and 55° C. When the discharge pH of xylose mother liquor is greater than 7.0, the variable-frequency mixer is interlockedly started for mixing, the $CO_2$ flow rate output by the $CO_2$ inlet regulating valve is interlockedly regulated to reach 0.5 L/h to 1 L/h so as to stabilize the pH value at 6.5-7.0, and the processed xylose mother liquor is discharged into the after-carbonation tank for temporary storage.

Further, the method of continuous carbonation and impurity removal for xylose mother liquor includes the following step.

At step 4, during normal operation, the system is continuously operated after steps 1-3 are established; the first pH sensor continuously monitors the discharge pH of xylose mother liquor for real-time control. When the pH value is less than a set value, the flow rate of the $Ca(OH)_2$ alkaline liquid is interlockedly regulated to increase to 55 L/h-60 L/h, and the alkaline liquid pump is interlockedly regulated for the flow rate to increase its operation frequency, and when the pH value is greater than the set value, the flow rate of the $Ca(OH)_2$ alkaline liquid is interlockedly regulated to decrease to 35 L/h-40 L/h, and the alkaline liquid pump is interlockedly decreased its operation frequency and the pH value of xylose mother liquor before being discharged to the first-level continuous carbonating unit is regulated to 9.5-10.5. The second pH sensor continuously monitors the discharge pH of xylose mother liquor for real-time control. When the pH value is less than the set value, the $CO_2$ flow rate interlockedly decreases to 17 L/h-20 L/h, and the first $CO_2$ inlet regulating valve is interlockedly regulated for the $CO_2$ flow rate to decrease its opening degree, and when the pH value is greater than the set value, the $CO_2$ flow rate interlockedly increases to 25 L/h-28 L/h, the first $CO_2$ inlet regulating valve is interlockedly regulated for the $CO_2$ flow rate to increase its opening degree, and the pH value of xylose mother liquor before being discharged to the second-level continuous carbonating unit is regulated to reach 8.0-8.5. The third pH sensor continuously monitors the discharge pH of xylose mother liquor for real time control: when the pH value is less than the set value, the $CO_2$ flow rate is interlockedly regulated to decrease to 1.8 L/h to 2 L/h, and the second $CO_2$ inlet regulating valve is interlockedly regulated for the $CO_2$ flow rate to decrease its opening degree, and when the pH value is greater than the set value, the $CO_2$ flow rate is interlockedly regulated to increase to 2.5 L/h-2.7 L/h, the second $CO_2$ inlet regulating valve is interlockedly regulated for the $CO_2$ flow rate to increase its opening degree, and the pH value of xylose mother liquor before being discharged to the discharge controlling unit is regulated to 6.5-7.0. The discharge pH sensor continuously monitors the pH for real time control: when the discharge pH of xylose mother liquor is less than 6.5, the variable-frequency mixer is interlockedly started for mixing, the vapor regulating valve is interlockedly regulated for its opening degree, to control the liquid temperature to 50° C.-55° C., and when the discharge pH of xylose mother liquor is greater than 7.0, the variable-frequency mixer is interlockedly started for mixing, the flow rate of the $CO_2$ inlet regulating valve is interlockedly regulated to reach 0.5 L/h-1 L/h so as to stabilize the pH value at 6.5-7.0, and xylose mother liquor is discharged into the after-carbonation tank for temporary storage.

Further, the method of performing continuous carbonation and impurity removal for xylose mother liquor includes the following step.

At step 5, when production is completed, xylose mother liquor in the before-carbonation tank all enters the first continuous carbonation tank, and the first discharge straight-through valve, the second discharge straight-through valve and the discharge straight-through valve are open sequentially, so that xylose mother liquor in the first continuous carbonation tank, the second continuous carbonation tank and the discharge carbonation tank are transferred to the after-carbonation tank respectively and then recovered into a xylose mother liquor storage tank through the pump.

Compared with the prior art, the device and the method for performing continuous carbonation and impurity removal for xylose mother liquor recycling according to the present disclosure present the following features.

1. Real-time pH monitoring and control can ensure the accurate usage of the $Ca(OH)_2$ alkaline liquid, and the final pH value of xylose mother liquor can be accurately controlled through two operations of continuous real-time pH monitoring and the carbonated discharge controlling unit.

2. The pH value of xylose mother liquor is stepwise decreased continuously, and the $CO_2$ can be fully used to facilitate the generation and precipitation of $CaCO_3$.

3. The content of $Ca^{2+}$ in the mother liquid may be effectively controlled by stabilizing the discharge pH value and temperature to reduce the pressure of subsequent ion exchange.

4. Continuous feeding and discharge is automatically operated at a higher efficiency to facilitate the large-scale and automatic operation of continuous impurity removal of xylose mother liquor.

5. The operation can be carried out simply by proper adjustment of parameters based on the composition of materials. After the operation, the amount of the alkaline liquid added to xylose mother liquor and the pH values at the end of three carbonations may be effectively controlled based on the pH of the alkaline liquid so as to control the usage amount of the $CO_2$.

BRIEF DESCRIPTION OF THE DRAWINGS

FIG. 1 is a principle diagram illustrating a device for performing continuous carbonation and impurity removal for xylose mother liquor according to a preferred embodiment of the present disclosure.

DETAILED DESCRIPTION OF THE EMBODIMENTS

To understand the technical problems, technical solutions and beneficial effects of the present disclosure more clearly, the present disclosure will be further described in detail below in combination with accompanying drawings and embodiments. It is to be understood that the specific embodiments described herein are only used to explain the present disclosure rather than limit the present disclosure.

FIG. 1 illustrates a preferred embodiment of a device for performing continuous carbonation and impurity removal for xylose mother liquor according to the present disclosure. The device includes an alkali addition unit 1, a continuous carbonating unit 2, a discharge controlling unit 3, a $CO_2$ supply station 4, a vapor station 5 and an after-carbonation tank 6. The alkali addition unit 1 is configured to add $Ca(OH)_2$ alkaline liquid into xylose mother liquor, and the continuous carbonating unit 2 is configured to introduce $CO_2$ supplied from the $CO_2$ supply station into the alkali-added xylose mother liquor to perform carbonation and mixing so as to remove impurities such as colloids and pigments in xylose mother liquor. The discharge controlling unit 3 is configured to introduce the $CO_2$ supplied from the $CO_2$ supply station 4 and vapor transported from the vapor station 5 into the carbonated xylose mother liquor to control and stabilize a pH value of the carbonated xylose mother liquor. The after-carbonation tank 6 is configured to collect and temporarily store the carbonated and impurity-removed xylose mother liquor to prepare for a next procedure.

The alkali addition unit 1 includes an alkaline liquid tank 11, an alkaline liquid pump 12, an alkali-pump variable-frequency controller 13, an alkaline liquid flow gauge 14, an alkaline liquid flow controller 15, a xylose mother liquor tank 16, a before-carbonation tank 17, a first pH sensor 18 and a first pH controller 19. The $Ca(OH)_2$ alkaline liquid is transported from the alkaline liquid tank 11 to the before-carbonation tank 17 through the alkaline liquid pump 12 and mixed with xylose mother liquor from xylose mother liquor tank 16 in the before-carbonation tank 17, and then, the mixed xylose mother liquor flows into the continuous carbonating unit 2. The alkali-pump variable-frequency controller 13 controls a flow rate of the alkaline liquid according to the pH value measured by the first pH sensor 18. The alkaline liquid flow gauge 14 monitors the flow rate of the flowing alkaline liquid. The first pH sensor 18 monitors the pH value of the alkali-added xylose mother liquor transported to the continuous carbonating unit 2. The alkali-pump variable-frequency controller 13, the alkaline liquid flow controller 15 and the first pH controller 19 are interlocked with each other, and the first pH controller 19 controls the alkali-pump variable-frequency controller 13 and the alkaline liquid flow controller 15 simultaneously according to a change of the pH value of the mixed xylose mother liquor monitored by the first pH sensor 18. Therefore, the flow rate of the alkaline liquid entering the before-carbonation tank 17 is controlled, and a discharge pH value of the alkali-added xylose mother liquor is regulated to reach a set value.

The continuous carbonating unit 2 includes a first continuous carbonation tank 21, a first switching valve 22, a first $CO_2$ inlet flow gauge 23, a first $CO_2$ inlet flow controller 24, a first $CO_2$ inlet regulating valve 25, a second pH sensor 26 and a second pH controller 27. The first continuous carbonation tank 21 collects the alkali-added xylose mother liquor, $CO_2$ in the $CO_2$ supply station 4 flows through the first $CO_2$ inlet flow gauge 23 and the first $CO_2$ inlet flow controller 24 and then enters the first continuous carbonation tank 21 to perform carbonation and impurity removal with xylose mother liquor therein, and the carbonated xylose mother liquor flows through the first switching valve 22 and then enters the discharge controlling unit 3. The second pH sensor 26 monitors a change of the pH value of the carbonated xylose mother liquor transported to the discharge controlling unit 3. The second pH controller 27, the first $CO_2$ inlet flow controller 24 and the first $CO_2$ inlet regulating valve 25 are interlocked with each other, and the second pH controller 27 controls the first $CO_2$ inlet flow controller 24 and the first $CO_2$ inlet regulating valve 25 simultaneously according to the change of the pH value of the carbonated xylose mother liquor monitored by the second pH sensor 23. Therefore, the flow rate of the $CO_2$ output by the $CO_2$ supply station 4 to the continuous carbonating unit 2 is controlled.

In this embodiment, the device for performing continuous carbonation and impurity removal for xylose mother liquor is provided with two levels of continuous carbonating units, and the first-level continuous carbonating unit is described as above. The second-level continuous carbonating unit 2' includes a second continuous carbonation tank 21', a second switching valve 22', a second $CO_2$ inlet flow gauge 23', a second $CO_2$ inlet flow controller 24', a second $CO_2$ inlet regulating valve 25', a third pH sensor 26' and a third pH controller 27'. The carbonated xylose mother liquor of the first-level continuous carbonating unit 2 flows through the second pH sensor 26 and the second pH controller 27 and then enters the second continuous carbonation tank 21' of the second-level continuous carbonating unit 2' to perform second carbonation and impurity removal, and the secondly-carbonated xylose mother liquor flows through the second switching valve 22' and then enters the discharge controlling unit 3. The $CO_2$ in the $CO_2$ supply station 4 flows through the second $CO_2$ inlet flow gauge 23' and the second $CO_2$ inlet flow controller 24' and then enters the second continuous carbonation tank 21' to perform second carbonation and mixing with xylose mother liquor therein. The third pH sensor 26' monitors a change of the pH value of the secondly-carbonated xylose mother liquor transported to the discharge controlling unit 3. The third pH controller 27', the second $CO_2$ inlet flow controller 24' and the second $CO_2$ inlet regulating valve 25' are interlocked with each other, and the third pH controller 27' controls the second $CO_2$ inlet flow controller 24' and the second $CO_2$ inlet regulating valve 25' simultaneously according to the change of the pH value of the carbonated xylose mother liquor monitored by the third pH sensor 26'. Therefore, the flow rate of the $CO_2$ output by the $CO_2$ supply station 4 to the second-level continuous carbonating unit 2' is controlled.

The first-level continuous carbonating unit 2 further includes a first discharge straight-through valve 28. When the first switching valve 22 is open, the carbonated xylose mother liquor in the first continuous carbonation tank 21 directly flows into the after-carbonation tank 6 rather than passes through a pipeline where the second pH sensor 26 and the second pH controller 27 are located. The second-level continuous carbonating unit 2' further includes a second discharge straight-through valve 28'. When the second switch valve 22' is open, the carbonated xylose mother liquor in the second continuous carbonation tank 21' directly flows into the after-carbonation tank 6 rather than passes through a pipeline where the third pH sensor 26' and the third pH controller 27' are located.

The discharge controlling unit 3 includes a discharge carbonation tank 31, a variable-frequency mixer 32, a tank temperature sensor 33, a tank temperature controller 34, a $CO_2$ inlet flow gauge 35, a $CO_2$ inlet flow controller 36, a $CO_2$ inlet regulating valve 37, a discharge pH sensor 38, a discharge pH controller 39, a vapor regulating valve 310, a vapor switching valve 311 and a discharge switching valve 312. The discharge carbonation tank 31 collects the carbonated xylose mother liquor transported from the second-level continuous carbonating unit 2'. The $CO_2$ in the $CO_2$ supply station 4 flows through the $CO_2$ inlet flow gauge 35 and the $CO_2$ inlet flow controller 36 and then enters the discharge carbonation tank 31, the vapor station 5 introduces vapor into the discharge carbonation tank 31 through the vapor regulating valve 310 and the vapor switching valve 311 so as to stabilize the pH value of the carbonated xylose mother liquor. Then, the processed xylose mother liquor flows through the discharge switching valve 312 and then enters the after-carbonation tank 6. The variable-frequency mixer 32 mixes xylose mother liquor in the discharge carbonation tank 31. The tank temperature sensor 33 monitors a temperature of the discharge carbonation tank 31. The discharge pH sensor 38 monitors a discharge pH value of xylose mother liquor. The variable-frequency mixer 32, the tank temperature controller 34, the discharge pH controller 39 and the vapor regulating valve 310 are interlocked with each other, and the tank temperature controller 34 regulates an opening degree of the vapor regulating valve 310 according to the discharge pH value and controls the variable-frequency mixer at the same time. The variable-frequency mixer 32, the $CO_2$ inlet flow controller 36, the $CO_2$ inlet regulating valve 37 and the discharge pH controller 39 are interlocked with each other, and the discharge pH controller 39 controls the flow rate of $CO_2$ output by the $CO_2$ supply station 4 to the discharge carbonation tank 31 according to the discharge pH value and controls the variable-frequency mixer 32 at the same time.

The discharge controlling unit 3 further includes a discharge straight-through valve 313. When the discharge switching valve 312 is open, the processed xylose mother liquor in the discharge carbonation tank 31 directly flows into the after-carbonation tank 6 rather than passes through a pipeline where the discharge pH sensor 38 and the discharge pH controller 39 are located.

The present disclosure further provides a method of performing continuous carbonation and impurity removal for xylose mother liquor by using the device for performing continuous carbonation and impurity removal for xylose mother liquor as described above. The method includes the following steps: xylose mother liquor is mixed with the added alkaline liquid in the alkali addition unit 1 and then enters the continuous carbonating unit 2 to perform carbonation and mixing with $CO_2$ supplied from the $CO_2$ supply station 4, and remove colloid and pigment impurities in xylose mother liquor, xylose mother liquor then enters the discharge controlling unit 3 to perform carbonation and mixing again with $CO_2$ supplied from the $CO_2$ supply station 4 and the vapor transported from the vapor station 5 to control and stabilize a pH value of the carbonated xylose mother liquor for ensuring the impurity removing effect, and then, the impurity-removed xylose mother liquor is discharged to the after-carbonation tank 6 for temporary storage so as to prepare for a next procedure.

An impurity removing principle of the method according to the present disclosure is as follows: $Ca(OH)_2$ and $CO_2$ are reacted to generate $CaCO_3$ precipitation, and the precipitation has positive charge to adsorb impurities such as colloids and pigments in xylose mother liquor at the same time. During the reaction of $Ca(OH)_2$ and $CO_2$, staged control is performed for the pH of xylose mother liquor to facilitate the generation of $CaCO_3$ flocculent precipitation. When xylose mother liquor is weakly alkaline, it helps $Ca^{2+}$ to be gradually converted into $CaCO_3$. When xylose mother liquor is neutral to very weakly acidic, it ensures most of $Ca^{2+}$ to be converted into $CaCO_3$ flocculent precipitation. When xylose mother liquor is very weakly acidic, it ensures the extreme trace amount excess of $CO_2$. In this way, $Ca^{2+}$ is completely converted into $CaCO_3$ precipitation, and even an extremely small portion is converted into $Ca(HCO_3)_2$, thereby avoiding a re-release of colloid impurities wrapped by $CaCO_3$ due to the generation of $Ca(HCO_3)_2$ and appearance of a large amount of $Ca^{2+}$ in xylose mother liquor at the same time. Therefore, the purpose of removing the impurities of xylose mother liquor is achieved without extra procedures.

Specifically, the method of performing continuous carbonation and impurity removal for xylose mother liquor includes the following steps.

At step 1, the pH of xylose mother liquor is increased by adding alkaline liquid: xylose mother liquor with a refraction index being 50%-65% is added to the before-carbonation tank 17 at a flow rate of 8 $m^3$/h to 12 $m^3$/h, when a liquid level reaches 30%-35% of the capacity of the before-carbonation tank 17, mixing is started and the alkaline liquid pump 12 is started to add $Ca(OH)_2$ alkaline liquid into the before-carbonation tank 17 with the frequency of the alkaline liquid pump 12 set to 30 Hz-40 Hz, and a flow rate of the $Ca(OH)_2$ alkaline liquid is 40 L/h-55 L/h at this time; the first pH sensor is set to 9.5-10.5 for real-time control, and discharge to the continuous carbonating unit is started when the liquid level of xylose mother liquor in the before-carbonation tank exceeds 70%. The first pH sensor 19 monitors the discharge pH of xylose mother liquor for real-time control: when the pH value is less than a set value, the flow rate of the $Ca(OH)_2$ alkaline liquid is interlockedly regulated to increase to 55 L/h to 60 L/h, and the alkaline liquid pump 12 is interlockedly regulated for the flow to increase the frequency of the alkaline liquid pump 12; when the pH value is greater than the set value, the flow rate of the $Ca(OH)_2$ alkaline liquid is interlockedly regulated to decrease to 35 L/h to 40 L/h, and the alkaline liquid pump 12 is interlockedly regulated to decrease the frequency of the alkaline liquid pump 12. Therefore, the discharge pH value of the alkali-added xylose mother liquor is regulated to reach the set value.

At step 2, the pH value of xylose mother liquor is stepwise decreased continuously.

When xylose mother liquor in the before-carbonation tank 17 is discharged to the first continuous carbonation tank 21 and when the liquid level of the alkali-added xylose mother liquor reaches 30%-35% of the capacity of the first continuous carbonation tank 21 of the first-level continuous carbonating unit 2, the mixing is started, an opening degree of the first $CO_2$ inlet regulating valve 25 is controlled to 50%-65%, and a $CO_2$ flow rate is 20 L/h to 25 L/h at this time; the second pH sensor 26 is set to 8.0-8.5, the first switching valve 22 is open, and discharge to the second-level continuous carbonating unit 2' is started when the liquid level of xylose mother liquor in the first continuous carbonation tank 21 exceeds 70%. The second pH sensor 26 monitors the discharge pH of xylose mother liquor for real-time control: when the pH value is less than the set value, the $CO_2$ flow rate is interlockedly regulated to decrease to 17 L/h to 20 L/h, and the first $CO_2$ inlet regulating valve 25 is interlockedly regulated for the $CO_2$ flow rate to decrease its opening degree; when the pH value is greater than the set value, the $CO_2$ flow rate is interlockedly regulated to increase to 25 L/h to 28 L/h, the first $CO_2$ inlet regulating valve 25 is interlockedly regulated for the $CO_2$ flow rate to increase its opening degree.

When xylose mother liquor in the first continuous carbonation tank 21 is discharged to the second continuous carbonation tank 21' and the liquid level reaches 30%-35% of the capacity of the second continuous carbonation tank 21' of the second-level continuous carbonating unit 2', the mixing is started, an opening degree of the second $CO_2$ inlet regulating valve 25' is controlled to 25%-40%, and the $CO_2$ flow rate is between 2 L/h and 2.5 L/h at this time; the third pH sensor 26' is set to 6.5-7.0 for real-time control, and the second switching valve 22' is open. When the liquid level of the second continuous carbonation tank 21' exceeds 70%, discharge to the discharge controlling unit 3 is started. The third pH sensor 26' monitors the discharge pH of xylose mother liquor for real-time control. when the pH value is less than the set value, the $CO_2$ flow rate is interlockedly regulated to decrease to 1.8 L/h to 2 L/h, and the second $CO_2$ inlet regulating valve 25' is interlockedly regulated for the $CO_2$ flow rate to decrease its opening degree; when the pH value is greater than the set value, the $CO_2$ flow rate is interlockedly regulated to increase to 2.5 L/h to 2.7 L/h, and the second $CO_2$ inlet regulating valve 25' is interlockedly regulated for the $CO_2$ flow rate to increase its opening degree.

At step 3, the discharge pH of the carbonated xylose mother liquor is stabilized: when xylose mother liquor in the second continuous carbonation tank 21' is discharged to the discharge carbonation tank 31, the discharge switching valve 312 is open, and the vapor switching valve 311 is open. The discharge pH sensor 38 is set to 6.5-7.0 for real-time control. The discharge pH sensor 38 monitors the discharge pH of xylose mother liquor for real-time control: when the discharge pH of xylose mother liquor is less than 6.5, the variable-frequency mixer 32 is interlockedly started for mixing at a frequency of 35 Hz to 45 Hz, and the vapor regulating valve 310 is interlockedly regulated for its opening degree at the same time, and thus a liquid temperature of xylose mother liquor is controlled to 50° C.-55° C.; when the discharge pH of xylose mother liquor is greater than 7.0, the variable-frequency mixer 32 is interlockedly started for mixing at the frequency of 35 Hz to 45 Hz, and the $CO_2$ flow rate output by the $CO_2$ inlet regulating valve 37 is interlockedly regulated to reach 0.5 L/h to 1 L/h so as to stabilize the pH value at 6.5-7.0, and the processed xylose mother liquor is discharged into the after-carbonation tank 6 for temporary storage.

At step 4, during a normal operation, a system of the device is operated continuously, that is, continuous feeding and continuous discharge are performed, after steps 1-3 are established. The first pH sensor 19 continuously monitors the discharge pH of xylose mother liquor for real-time control: when the pH value is less than the set value, the flow rate of the $Ca(OH)_2$ alkaline liquid is interlockedly regulated to increase to 55 L/h to 60 L/h, and the alkaline liquid pump 12 is interlockedly regulated for the flow rate to increase its operation frequency; when the pH value is greater than the set value, the flow rate of the $Ca(OH)_2$ alkaline liquid is interlockedly regulated to decrease to 35 L/h to 40 L/h, the alkaline liquid pump 12 is interlockedly regulated to decrease its operation frequency, and the pH value of xylose mother liquor before being discharged to the first-level continuous carbonating unit 2 is regulated to 9.5-10.5. The second pH sensor 26 continuously monitors the discharge pH of xylose mother liquor for real-time control: when the pH value is less than the set value, the $CO_2$ flow rate is interlockedly regulated to decrease to 17 L/h to 20 L/h, and the first $CO_2$ inlet regulating valve 25 is interlockedly regulated for the $CO_2$ flow rate to decrease its opening degree; when the pH value is greater than the set value, the $CO_2$ flow rate is interlockedly regulated to increase to 25 L/h to 28 L/h, the first $CO_2$ inlet regulating valve 25 is interlockedly regulated for the $CO_2$ flow rate to increase its opening degree, and the pH value of xylose mother liquor before being discharged to the second-level continuous carbonating unit 2' is regulated to reach 8.0-8.5. The third pH sensor 26' continuously monitors the discharge pH of xylose mother liquor for real-time control: when the pH value is less than the set value, the $CO_2$ flow rate is interlockedly regulated to decrease to 1.8 L/h to 2 L/h, and the second $CO_2$ inlet regulating valve 25' is interlockedly regulated for the $CO_2$ flow rate to decrease its opening degree; when the pH value is greater than the set value, the $CO_2$ flow rate is interlockedly regulated to increase to 2.5 L/h to 2.7 L/h, the second $CO_2$ inlet regulating valve is interlockedly regulated for the $CO_2$ flow rate to increase its opening degree, and the pH value of xylose mother liquor before being discharged to the discharge controlling unit 3 is regulated to 6.5-7.0. The discharge pH sensor 38 continuously monitors the pH of xylose mother liquor for real-time control: when the discharge pH of xylose mother liquor is less than 6.5, the variable-frequency mixer 32 is interlockedly started for mixing at the frequency of 35 Hz to 45 Hz, the vapor regulating valve 310 is interlockedly regulated for its opening degree so as to control the liquid temperature to 50° C.-55° C.; when the discharge pH of xylose mother liquor is greater than 7.0, the variable-frequency mixer 32 is interlockedly started for mixing at the frequency of 35 Hz to 45 Hz, and the flow rate of the $CO_2$ inlet regulating valve 37 is interlockedly regulated to reach 0.5 L/h to 1 L/h, so as to stabilize the pH value at 6.5-7.0, and xylose mother liquor is discharged into the after-carbonation tank for temporary storage.

At step 5, when production is completed, xylose mother liquor material in the before-carbonation tank 17 all enters the first continuous carbonation tank 21, and the first discharge straight-through valve 28, the second discharge straight-through valve 28' and the discharge straight-through valve 313 are open sequentially, so that xylose mother liquor materials in the first continuous carbonation tank 21, the second continuous carbonation tank 21' and the discharge carbonation tank 31 are transferred to the after-carbonation tank 6 respectively and recovered into a xylose mother liquor storage tank through the pump.

The device and the method of the present disclosure will be further described below in combination with specific embodiments.

Embodiment 1

Carbonation was performed with xylose mother liquor at pH 3.5, a refraction index of 60%, xylose content of 52% and a flow rate of 10 $m^3/h$ according to the method of the present disclosure.

At step 1, by the online monitoring of the first pH sensor 18, the $Ca(OH)_2$ flow rate was interlockedly controlled to 50 L/h, the frequency of the alkaline liquid pump 12 was controlled to 36 Hz, and the pH value of xylose mother liquor was interlockedly controlled and regulated to 9.5.

At step 2, the pH value of xylose mother liquor was continuously decreased stepwise through the processes of the first-level continuous carbonating unit 2 and the second-level continuous carbonating unit 2'. By the real-time monitoring of the second pH sensor 26, the first-level continuous carbonating unit 2 interlockedly controlled the opening degree of the $CO_2$ inlet regulating valve to 60%, and the flow rate to 22 L/h, and interlockedly controlled the pH value of xylose mother liquor to 8.0. Then, by the online monitoring of the third pH sensor 26', the second-level controlling unit 2' interlockedly controlled the opening degree of the $CO_2$ inlet regulating valve to 35% and the flow rate to 2 L/h, and interlockedly controlled the pH value of xylose mother liquor to 7.0.

At step 3, the discharge controlling unit 3 stabilized the discharge pH of the carbonated xylose mother liquor. The discharge pH sensor 38 interlockedly controlled the $CO_2$ flow rate to 1 L/h online, so that the opening degree of the $CO_2$ inlet regulating valve 37 was flow-controlled to 15%, and the final pH value of xylose mother liquor was 6.5.

The removal of impurities can be achieved through the above three steps for discharging xylose mother liquor, thereby satisfying feeding requirements of subsequent procedures.

Embodiment 2

Carbonation was performed with xylose mother liquor at pH 4.0, a refraction index of 65%, xylose content of 55% and a flow rate of 10 $m^3/h$ according to the method of the present disclosure.

At step 1, by real-time monitoring of the first pH sensor 18, the $Ca(OH)_2$ flow rate was interlockedly controlled to 40 L/h, the frequency of the alkaline liquid pump 12 was controlled to 30 Hz, and the pH value of xylose mother liquor was interlockedly controlled and regulated to 10.

At step 2, the pH value of xylose mother liquor was stepwise decreased continuously through the processes of the first-level continuous carbonating unit 2 and the second-level continuous carbonating unit 2'. By the online monitoring of the second pH sensor 26, the first-level continuous carbonating unit 2 interlockedly controlled the opening degree of the $CO_2$ inlet regulating valve to 70%, and the flow rate to 25 L/h, and the pH value of xylose mother liquor was interlockedly controlled and regulated to 8.5. Then, by the online monitoring of the third pH sensor 26', the second-level continuous carbonating unit 2' interlockedly controlled the opening degree of the $CO_2$ inlet regulating valve 37 to 40% and the flow rate to 2.5 L/h, and the pH value of xylose mother liquor was interlockedly controlled and regulated to 6.5.

At step 3, the discharge controlling unit 3 stabilized the discharge pH of the carbonated xylose mother liquor. The discharge pH sensor 38 interlockedly controlled temperature to 50° C. and the opening degree of the vapor regulating valve 310 to 30%; at the same time, the discharge pH sensor interlockedly controlled the mixing frequency of the variable-frequency mixer 32 to 45 Hz and the opening degree of the $CO_2$ inlet regulating valve 37 to 0%, and the final pH value of xylose mother liquor was 6.5.

The impurity removing effect can be achieved through the above three steps for discharging xylose mother liquor, thereby satisfying feeding requirements of subsequent procedures.

The foregoing disclosure is merely illustrative of preferred embodiments of the present disclosure but not intended to limit the present disclosure, and any modifications, equivalent substitutions and adaptations thereof made within the spirit and principles of the present disclosure shall be encompassed in the scope of protection of the present disclosure.

The invention claimed is:

1. A device for performing continuous carbonation and impurity removal for xylose mother liquor, comprising an alkali adding unit, a first-level continuous carbonating unit, a discharge controlling unit, a $CO_2$ supply station, a vapor station and an after-carbonation tank, wherein the alkali adding unit is configured to add $Ca(OH)_2$ alkaline liquid into the xylose mother liquor, the first-level continuous carbonating unit is configured to introduce $CO_2$ supplied from the $CO_2$ supply station into the alkali-added xylose mother liquor to perform carbonation and mixing so as to remove colloid and pigment impurities in the xylose mother liquor, the discharge controlling unit is configured to introduce the $CO_2$ supplied from the $CO_2$ supply station and vapor transported from the vapor station into the carbonated xylose mother liquor so as to control and stabilize a pH value of the carbonated xylose mother liquor, and the after-carbonation tank is configured to collect and temporarily store the carbonated and impurity-removed xylose mother liquor so as to prepare for a next procedure, the discharge controlling unit comprises a discharge carbonation tank, a variable-frequency mixer, a tank temperature sensor, a tank temperature controller, a $CO_2$ inlet flow controller, a $CO_2$ inlet regulating valve, a discharge pH sensor, a discharge pH controller, a vapor regulating valve and a discharge switching valve, the discharge carbonation tank is configured to collect the carbonated xylose mother liquor transported from the first-level continuous carbonating unit, and is configured to receive the $CO_2$ in from the $CO_2$ supply station that flows through the $CO_2$ inlet flow controller, the vapor station is configured to introduce vapor into the discharge carbonation tank through the vapor regulating valve, the after-carbonation tank is configured to store the processed xylose mother liquor flowing through the discharge switching valve, the variable-frequency mixer is configured to mix the xylose mother liquor in the discharge carbonation tank, the tank temperature sensor is configured to monitor a temperature of the discharge carbonation tank, the discharge pH sensor is configured to monitor a discharge pH value of the xylose mother liquor, the variable-frequency mixer, the tank temperature controller, the discharge pH controller and the vapor regulating valve are interlocked with each other, the tank temperature controller is configured to regulate an opening degree of the vapor regulating valve according to the discharge pH value and controls the variable-frequency mixer at the same time, the variable-frequency mixer, the $CO_2$ inlet flow controller, the $CO_2$ inlet regulating valve and the discharge pH controller are interlocked with each other, and the discharge pH controller is configured to control a flow rate of the $CO_2$ output by the $CO_2$ supply station to the discharge carbonation tank based on the discharge pH value and controls the variable-frequency mixer at the same time.

2. The device according to claim 1, wherein the alkali liquid adding unit comprises an alkaline liquid tank, an alkaline liquid pump, a xylose mother liquor tank, a before-carbonation tank and a first pH sensor, the alkali liquid adding unit is configured to transport an alkaline liquid from the alkaline liquid tank to the before-carbonation tank through the alkaline liquid pump and mix the alkaline liquid with the xylose mother liquor from the xylose mother liquor tank in the before-carbonation tank, and transport the mixed xylose mother liquor into the first-level continuous carbonating unit, and the first pH sensor is configured to monitor the pH value of the alkali-added xylose mother liquor transported to the first-level continuous carbonating unit.

3. The device according to claim 2, wherein the first-level continuous carbonating unit comprises a first continuous carbonation tank, a first switching valve, a first $CO_2$ inlet regulating valve and a second pH sensor, the first continuous carbonation tank is configured to collect the alkali-added xylose mother liquor, to receive the $CO_2$ in from the $CO_2$ supply station to perform carbonation and impurity removal with the xylose mother liquor, and to transport the carbonated xylose mother liquor through the first switching valve into the discharge controlling unit, and the second pH sensor is configured to monitor a change of the pH value of the carbonated xylose mother liquor transported to the discharge controlling unit.

4. The device according to claim 3, further comprising a second-level continuous carbonating unit, wherein the second-level continuous carbonating unit comprises a second continuous carbonation tank, a second switching valve, a second $CO_2$ inlet regulating valve and a third pH sensor, the second-level continuous carbonating unit is configured to receive the carbonated xylose mother liquor from the first-level continuous carbonating unit in the second continuous carbonation tank under the control of the second pH controller to perform second carbonation and impurity removal, to receive the $CO_2$ from the $CO_2$ supply station in the second continuous carbonation tank to perform second carbonation and mixing with the xylose mother liquor, and to transport the secondly-carbonated xylose mother liquor through the second switching valve into the discharge controlling unit, and the third pH sensor is configured to monitor a change of the pH value of the secondly-carbonated xylose mother liquor transported to the discharge controlling unit.

5. The device according to claim 4, wherein the first-level continuous carbonating unit further comprises a first discharge straight-through valve for enabling the carbonated xylose mother liquor in the first continuous carbonation tank to directly flow into the after-carbonation tank rather than pass through a pipeline where the second pH sensor is located when the first switching valve is opened;

the second-level continuous carbonating unit further comprises a second discharge straight-through valve for enabling the carbonated xylose mother liquor in the second continuous carbonation tank to directly flow into the after-carbonation tank rather than pass through a pipeline where the third pH sensor is located when the second switching valve is opened.

6. The device according to claim 5, wherein the discharge controlling unit further comprises a discharge straight-through valve for enabling the processed xylose mother liquor in the discharge carbonation tank to directly flow into the after-carbonation tank rather than pass through a pipeline where the discharge pH sensor is located when the discharge switching valve is opened.

7. A method of performing continuous carbonation and impurity removal for xylose mother liquor by using the device for performing continuous carbonation and impurity removal for xylose mother liquor according to claim 6, comprising the following steps:

mixing the xylose mother liquor with the added alkaline liquid in the alkali adding unit to form a mixed xylose mother liquor, transporting the mixed xylose mother liquor into at least one continuous carbonating unit to perform carbonation and to be mixed with $CO_2$ supplied from the $CO_2$ supply station so as to remove colloid and pigment impurities in the xylose mother liquor, transporting the xylose mother liquor into the discharge controlling unit to perform carbonation and mixing again with the $CO_2$ supplied from the $CO_2$ supply station and vapor transported from the vapor station to control and stabilize a pH value of the carbonated xylose mother liquor, and discharging the impurity-removed xylose mother liquor to the after-carbonation tank for temporary storage so as to prepare for a next procedure.

8. The method according to claim 7, comprising the following steps:

at step 1, increasing the pH of the xylose mother liquor by adding the alkaline liquid, the step 1 comprising:

adding xylose mother liquor with a refraction index being 50%-65% into the before-carbonation tank at a flow rate of 8 $m^3$/h to 12 $m^3$/h, adding $Ca(OH)_2$ alkaline liquid into the before-carbonation tank when a liquid level reaches 30%-35% of the capacity of the before-carbonation tank, and a flow rate of the $Ca(OH)_2$ alkaline liquid is 40 L/h to 55 L/h; and setting the first pH sensor to 9.5-10.5, and starting discharging to the continuous carbonating unit when the liquid level of the xylose mother liquor in the before-carbonation tank exceeds 70%;

at step 2, continuously and stepwise decreasing the pH value of the xylose mother liquor, the step 2 comprising:

when the liquid level of the alkali-added xylose mother liquor reaches 30%-35% of the capacity of the first continuous carbonation tank of the first-level continuous carbonating unit, controlling an opening degree of the first $CO_2$ inlet regulating valve to 50%-65%, and a $CO_2$ flow rate being 20 L/h to 25 L/h; and setting the second pH sensor to 8.0-8.5, opening the first switching valve, and starting discharging to the second-level continuous carbonating unit when the liquid level of the xylose mother liquor in the first continuous carbonation tank exceeds 70%; and when the liquid level reaches 30%-35% of the capacity of the second continuous carbonation tank of the second-level continuous carbonating unit, controlling an opening degree of the second $CO_2$ inlet regulating valve to 25%-40%, and a $CO_2$ flow rate being 2 L/h to 2.5 L/h; and setting the third pH sensor to 6.5-7.0, opening the second switching valve, and starting discharging to the discharge controlling unit when the liquid level of the xylose mother liquor in the second continuous carbonation tank exceeds 70%; and at step 3, stabilizing a discharge pH of the carbonated xylose mother liquor, the step 3 comprising:

when the xylose mother liquor in the second continuous carbonation tank is discharged to the discharge carbonation tank, opening the discharge switching valve, and opening the vapor switching valve; and setting the discharge pH sensor to 6.5-7.0, wherein the discharge pH sensor continuously monitors the pH as follows: when the discharge pH of the xylose mother liquor is less than 6.5, interlockedly starting the variable-frequency mixer for mixing, and interlockedly regulating an opening degree of the vapor regulating valve to control a liquid temperature of the xylose mother liquor to 50° C.-55° C.; when the discharge pH of the xylose mother liquor is greater than 7.0, interlockedly starting the variable-frequency mixer for mixing, interlockedly regulating the $CO_2$ flow rate output by the $CO_2$ inlet regulating valve to reach 0.5 L/h to 1 L/h so as to stabilize the pH value at 6.5-7.0, and discharging the processed xylose mother liquor into the after-carbonation tank for temporary storage.

9. The method according to claim 8, further comprising the following step that:

at step 4, a system is continuously operated after steps 1-3 are established;

the first pH sensor continuously monitors the discharge pH of the xylose mother liquor as follows: when the pH value is less than a set value, the flow rate of the $Ca(OH)_2$ alkaline liquid is interlockedly regulated to increase to 55 L/h to 60 L/h, and the alkaline liquid pump is interlockedly regulated for the flow rate to increase an operation frequency of the alkaline liquid pump; when the pH value is greater than the set value, the flow rate of the $Ca(OH)_2$ alkaline liquid is interlockedly regulated decrease to 35 L/h to 40 L/h, the alkaline liquid pump is interlockedly regulated to decrease the operation frequency of the alkaline liquid pump, and the pH value of the xylose mother liquor before being discharged to the first-level continuous carbonating unit is regulated to 9.5-10.5;

the second pH sensor continuously monitors the discharge pH of the xylose mother liquor as follows: when the pH value is less than the set value, the flow rate of the $CO_2$ alkaline liquid is interlockedly regulated to decrease to 17 L/h to 20 L/h, and the first $CO_2$ inlet regulating valve is interlockedly regulated for the $CO_2$ flow rate to decrease the opening degree of the first $CO_2$ inlet regulating valve; when the pH value is greater than the set value, the $CO_2$ flow rate is interlockedly regulated to increase to 25 L/h to 28 L/h, the first $CO_2$ inlet regulating valve is interlockedly regulated for the $CO_2$ flow rate to increase the opening degree of the first $CO_2$ inlet regulating valve, and the pH value of the xylose mother liquor before being discharged to the second-level continuous carbonating unit is regulated to reach 8.0-8.5; and the third pH sensor continuously monitors the discharge pH of the xylose mother liquor as follows: when the pH value is less than the set value, the $CO_2$ flow rate is interlockedly regulated to decrease to 1.8 L/h to 2 L/h, and the second $CO_2$ inlet regulating valve is interlockedly regulated for the $CO_2$ flow rate to decrease the open degree of the second $CO_2$ inlet regulating valve; when the pH value is greater than the set value, the $CO_2$ flow rate is interlockedly regulated to increase to 2.5 L/h to 2.7 L/h, the second $CO_2$ inlet regulating valve is interlockedly regulated for the $CO_2$ flow rate to increase the opening degree of the second $CO_2$ inlet regulating valve, and the pH value of the xylose mother liquor before being discharged to the discharge controlling unit is regulated to 6.5-7.0.

10. The method according to claim 8, further comprising the following step that:

at step 5, when production is completed, the xylose mother liquor material in the before-carbonation tank enters the first continuous carbonation tank, and the first discharge straight-through valve, the second discharge straight-through valve and the discharge straight-through valve are opened sequentially in such a way that the xylose mother liquor materials in the first continuous carbonation tank, the second continuous carbonation tank and the discharge carbonation tank are transferred to the after-carbonation tank respectively and recovered into a xylose mother liquor storage tank through the pump.

* * * * *